US008161578B1

(12) United States Patent
Chou

(10) Patent No.: US 8,161,578 B1
(45) Date of Patent: Apr. 24, 2012

(54) PADDING DEVICE FOR SWIMMING/DIVING GOGGLES

(76) Inventor: Terry Chou, Tainan (TW)

( * ) Notice: Subject to any disclaimer, the term of this patent is extended or adjusted under 35 U.S.C. 154(b) by 0 days.

(21) Appl. No.: 12/972,481

(22) Filed: Dec. 19, 2010

(51) Int. Cl.
*A61F 9/02* (2006.01)

(52) U.S. Cl. ..... 2/428; 2/440

(58) Field of Classification Search ..... 2/426, 424, 2/9, 12, 15, 427, 428, 440, 430, 431, 441, 2/442, 439, 444, 447, 449
See application file for complete search history.

(56) References Cited

U.S. PATENT DOCUMENTS 1,850,812 A * 3/1932 Scharf ..... 2/440
2,407,518 A * 9/1946 Schauweker ..... 2/436
3,027,562 A * 4/1962 Widenor ..... 2/430
5,617,588 A * 4/1997 Canavan et al. ..... 2/428
5,894,606 A * 4/1999 Chiang ..... 2/440
6,032,298 A * 3/2000 Chiang ..... 2/428
6,276,795 B1 * 8/2001 Hall et al. ..... 351/62
6,343,386 B1 * 2/2002 Chou ..... 2/428
7,526,813 B2 * 5/2009 Tominaga et al. ..... 2/13

* cited by examiner

*Primary Examiner* — Gary L Welch
*Assistant Examiner* — Brieanna Fuller

(57) ABSTRACT

A padding device includes a connecting portion for engaging with a body of a pair of swimming/diving goggles. The connecting portion includes a lateral wall extending between front and rear walls. An annular, outer wall extension extends rearward from the lateral wall. A front connecting wall extends from the outer wall extension. An annular, inner wall extension extends perpendicularly to and rearward from an inner edge of the rear wall. A bend extends outward from an inner end of the inner wall extension and has a rear connecting wall located behind the front connecting wall. A spacing portion is defined between the inner and outer wall extensions. The front and rear connecting walls are engaged with each other and seal the spacing.

1 Claim, 15 Drawing Sheets

PADDING DEVICE FOR SWIMMING/DIVING GOGGLES

BACKGROUND OF THE INVENTION

The present invention relates to a padding device for swimming/diving goggles and, more particularly, to a padding device for swimming/diving goggles with enhanced air-tight effect, wearing comfort, increased vision, and product consistency.

Conventional swimming/diving goggles generally include a soft padding member for contacting with a face of a wearer to provide wearing comfort. The padding member includes air cushioning structure to provide enhanced softness. FIG. 13 shows a conventional padding device in the form of an integrally formed ring 1' having a hollow portion 11' filled with gas. The ring 1' is fixed to a main frame of swimming goggles and comes in contact with a face of a wearer to provide enhanced wearing comfort.

However, the amount of gas filled in the ring 1' differs due to a change in the temperature and/or pressure in the mold. Different rings 1' produced by mass production have different amounts of gas and different pressures, resulting in product inconsistency. Furthermore, a pressure larger than the atmospheric pressure is required to inflate the ring 1' so that the ring 1' can have circular cross sections. The touch of the ring 1' is rigid due to the larger pressure, failing to provide wearing comfort.

The ring 1' can include a nozzle formed during formation. The gas can be filled into the ring 1' via the nozzle to avoid excessive pressure. However, filling of the gas via the nozzle is not convenient while having the same problem of product inconsistency due to different pressures in different rings 1'. Furthermore, the sealing is a problem after filling. The gas is liable to leak out of the hollow portion 11' after a period of time, failing to provide sufficient pressure and sufficient elasticity.

With reference to FIG. 14, in use, water is liable to accumulate in a gap A exists between the ring 1' and the face of the wearer. The accumulated water will leak into the body 2' when the body 2' is moved by external force, failing to provide waterproof effect.

FIG. 15 shows another conventional padding device 3' including a side having a connecting portion 31' connected to a body 4' of swimming goggles. The other side of the padding device 3' includes an annular face 32' for contacting with a face of a wearer. A cushioning portion 33' is formed between the connecting portion 31' and the annular face 32' and includes a hollow portion 331' filled with gas to provide cushioning effect for the padding device 3'. The waterproof effect of the padding device 3' is superior to that of the ring 1' of FIG. 13 due to intimate contact between the annular face 32' and the face of the wearer. However, the cushioning portion 33' is formed by a method the same as that for forming the ring 1' and, thus, has the same disadvantages of excessive rigidity or aptness of gas leakage as the ring 1'.

FIGS. 16 and 17 show a further conventional padding device 5' including a connecting portion 51' connected to a body 6' of swimming goggles. An interior wall 52' is provided behind the connecting portion 51'. The interior wall 52' has a coupling edge 53' having a length B suitable for bonding. An extension 54' extends rearward from an outer periphery of the connecting portion 51' and includes a contact portion 55' for contact with a face of a wearer. The contact portion 55' extends beyond the extension 54'. A coupling edge 56' extends inward from an inner edge of the contact portion 55'. A space 57' is formed between the contact portion 55' and the interior wall 52'. With reference to FIG. 17, the coupling edges 53' and 56' are bonded together by adhesive 7' to seal the space 57', providing an annular sealed area. The pressure in the space 57' is equal to the atmospheric pressure to provide softness and wearing comfort while providing product consistency by providing consistent pressure in the spaces 57' of different padding devices 5' manufactured by mass production. The contact portion 55' is in intimate contact with the face of the wearer, providing enhanced waterproof effect.

However, the wearer can not see through the lengths B of the coupling edges 53' and 56' that are required for applying the adhesive 7', providing a narrower view.

FIG. 17 shows that the viewing angle C is limited by the lengths B of the coupling edges 53' and 56' and, thus, smaller than the largest viewing angle D without the coupling edges 53' and 56'. Furthermore, leakage of the gas out of the space 57' occurs if the bonding effect provided by the adhesive 7' is insufficient.

BRIEF SUMMARY OF THE INVENTION

An objective of the present invention is to provide a padding device for swimming/diving goggles with enhanced air-tight effect, wearing comfort, increased vision, and product consistency.

A padding device for swimming/diving goggles according to the present invention includes a connecting portion adapted to engage with a body of a pair of swimming/diving goggles. The connecting portion includes front and rear walls and a lateral wall extending between the front and rear walls. An annular, outer wall extension extends rearward from the lateral wall of the engaging portion. A front connecting wall extends from the annular, outer wall extension. An annular, inner wall extension extends perpendicularly to and rearward from an inner edge of the rear wall of the engaging portion. A bend extends outward from an inner end of the annular, inner wall extension and has a rear connecting wall located behind the front connecting wall. A spacing portion is defined between the annular, inner and outer wall extensions. Each of the front and rear connecting walls has an engagement face. The engagement faces of the front and rear connecting walls are engaged with each other and seal the spacing portion to form a sealed cushion. An annular engagement wall is connected to outer edges of the front and rear connecting walls and extends perpendicularly to the annular, outer wall extension.

In an embodiment, each of the front and rear connecting walls extends outward and perpendicularly to and beyond the annular, outer wall extension.

In an embodiment, the engagement faces of the front and rear connecting walls are engaged with each other by adhesive to seal the spacing portion.

In another embodiment, the engagement wall is engaged with the front and rear connecting walls by injection molding. The engagement wall seals and covers a gap between the front and rear connecting walls. The engagement wall is bonded to the front and rear connecting walls by adhesive.

In another embodiment, the engagement wall is engaged with lateral faces of the front and rear connecting walls, a front face of the front connecting wall, and a rear face of the rear connecting wall.

The present invention will become clearer in light of the following detailed description of illustrative embodiments of this invention described in connection with the drawings.

DETAILED DESCRIPTION OF THE INVENTION

Figure 1:
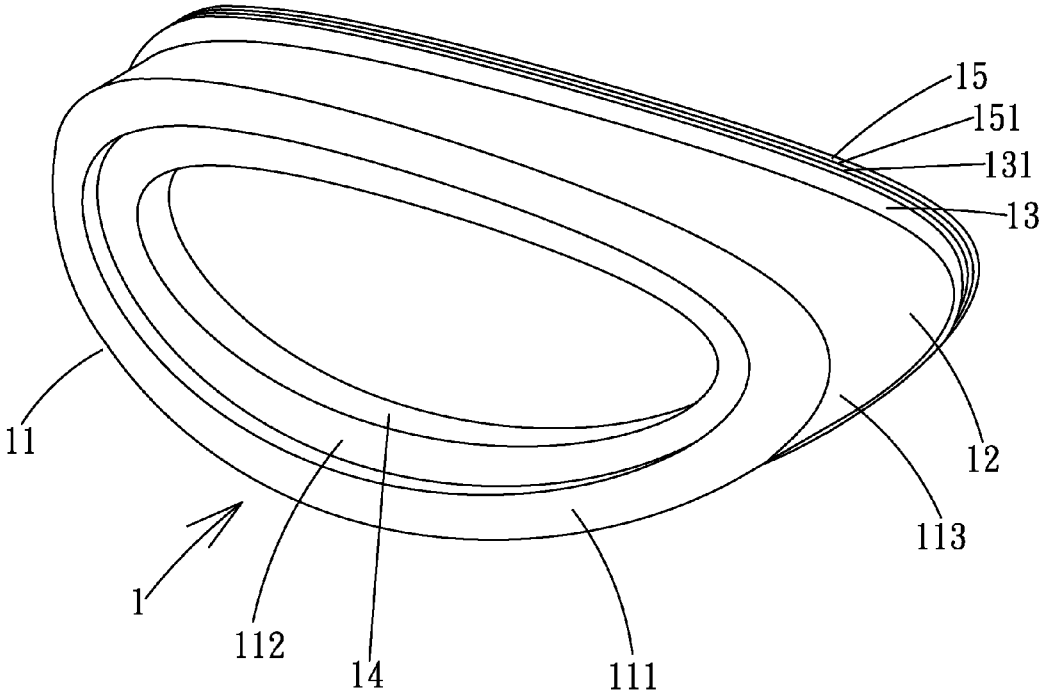
FIG. 1 shows a perspective view of a semi-product of a padding device of a first embodiment according to the present invention.
Figure 2:
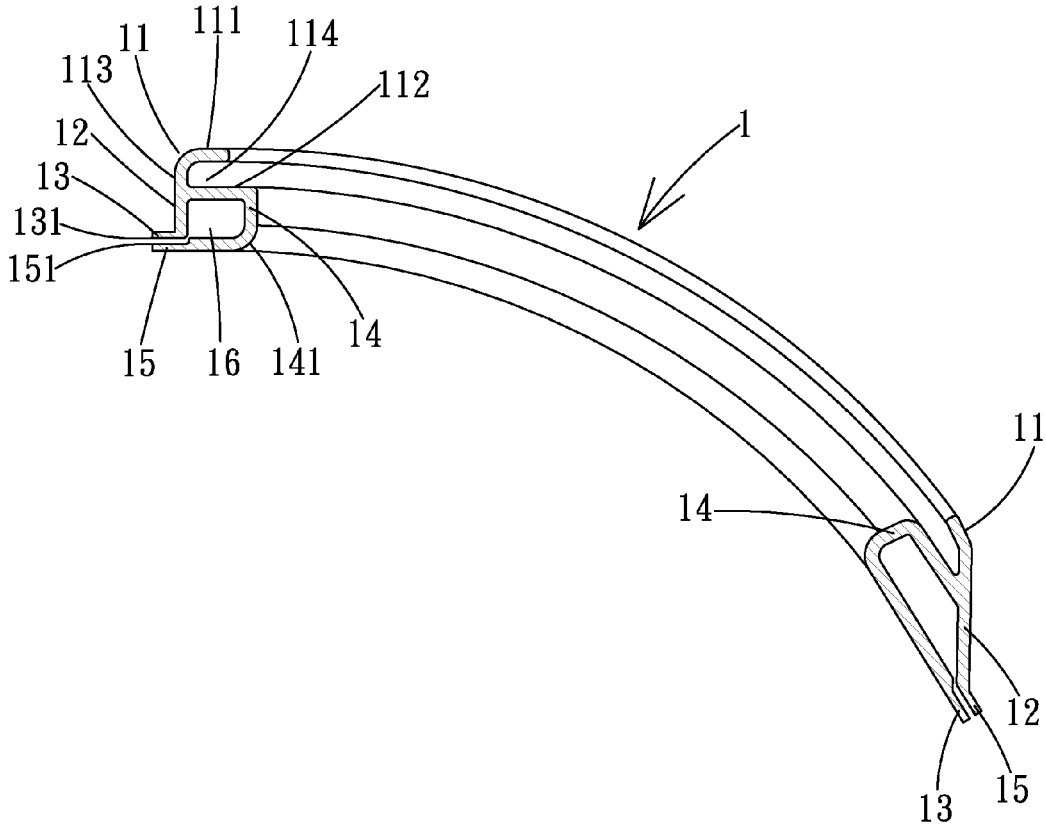
FIG. 2 shows a cross sectional view of the padding device of FIG. 1.
Figure 7:
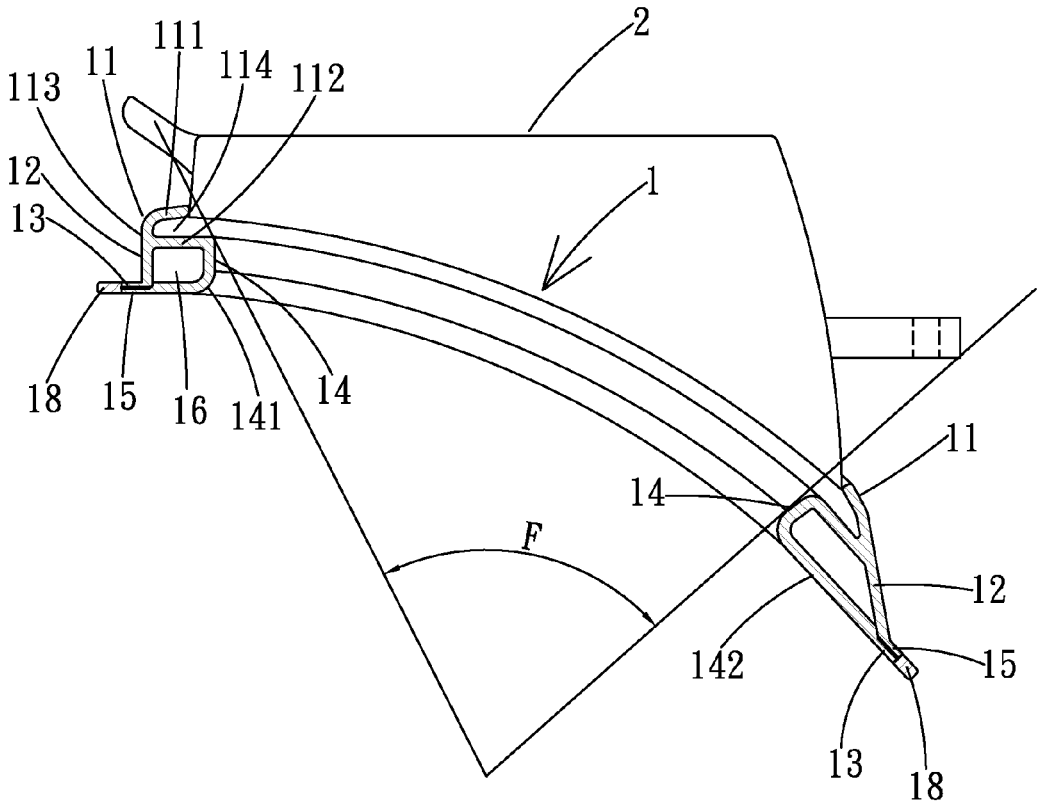
FIG. 7 shows a pair of swimming/diving goggles using the padding device of the first embodiment according to the present invention.

With reference to FIGS. 1 and 2, a padding device 1 of a first embodiment according to the present invention is annular and formed of soft material. The semi-product of the padding device 1 includes an annular engaging portion 11 for engagement with a body 2 of a pair of swimming/diving goggles (FIG. 7). The engaging portion 11 includes spaced front and rear walls 111 and 112 and a lateral wall 113 extending between the front and rear walls 111 and 112. A compartment 114 is defined between the front and rear walls 111 and 112 and the lateral wall 113. The compartment 114 receives and clamps the body 2 by flexibility and resiliency of the padding device 1.

An annular, outer wall extension 12 extends rearward from the lateral wall 113 of the engaging portion 11. A front connecting wall 13 extends outward from the annular, outer wall extension 12 and has an appropriate length such that the front connecting wall 13 has a larger engagement face 131.

An annular, inner wall extension 14 extends perpendicularly to and rearward from an inner edge of the rear wall 112 of the engaging portion 11. A bend 141 extends outward from an inner end of the annular, inner wall extension 14 and has a rear connecting wall 15 located behind the front connecting wall 13. The rear connecting wall 15 is aligned with and spaced from the front connecting wall 13. A spacing portion 16 is defined between the annular, inner and outer wall extensions 14 and 12. The rear connecting wall 15 has an appropriate length beyond the annular wall extension 14, providing a larger engagement face 151.

Figure 3:
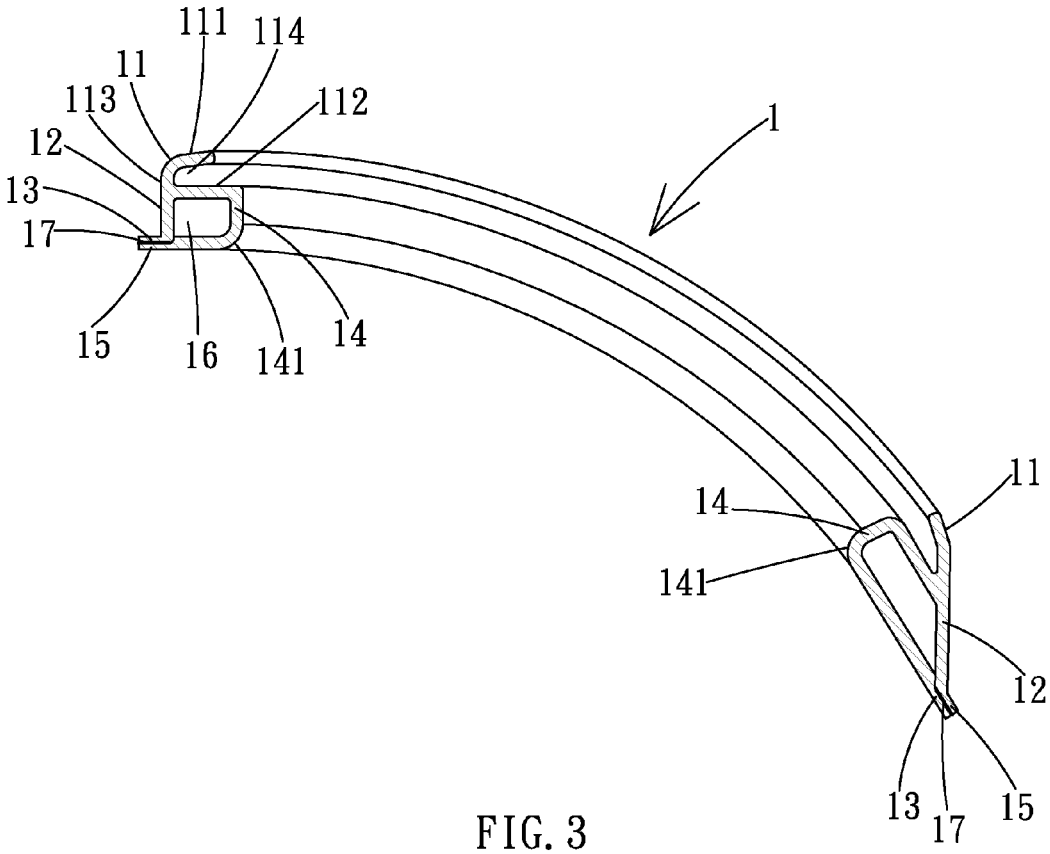
FIG. 3 is a view similar to FIG. 2, wherein a compartment of the padding device is sealed.
Figure 4:
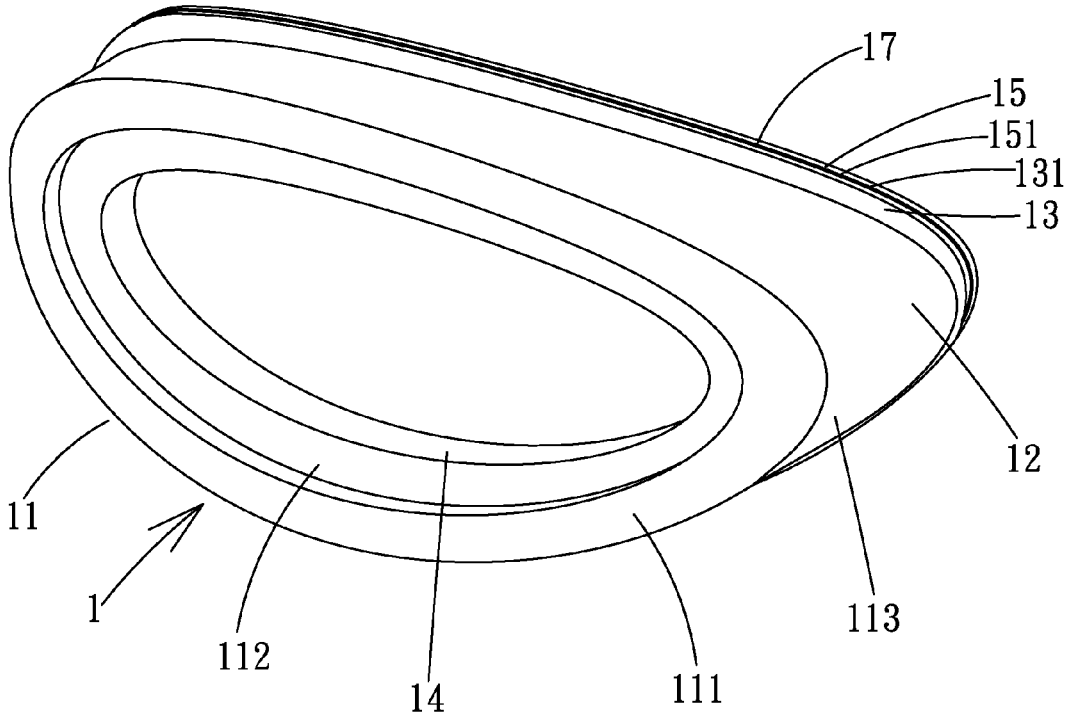
FIG. 4 shows a perspective view of the padding device of FIG. 3.

With reference to FIGS. 3 and 4, the engagement faces 131 and 151 of the front and rear connecting walls 13 and 15 are bonded together by adhesive 17 to seal the spacing portion 16, providing a semi-processed product. The pressure in the spacing portion 16 is equal to the atmospheric pressure. The spacing portion 16 is an annular, endless cushion. The gas in the spacing portion 16 will not leak even if the padding device 1 is squeezed during use, providing softness and wearing comfort.

Figures 5, 5A:
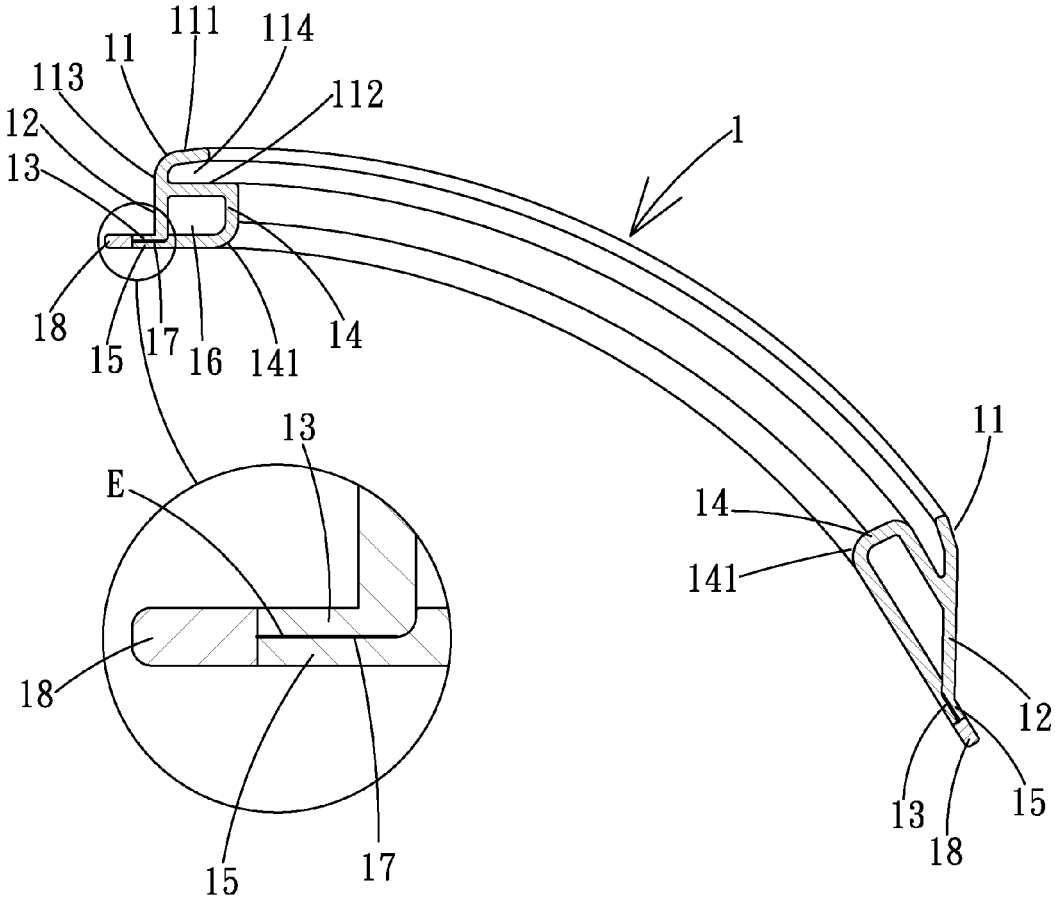
FIG. 5 shows a cross sectional view of a final product of the padding device of the first embodiment according to the present invention.
FIG. 5A shows an enlarged view of a circled portion of FIG. 5.
Figure 6:
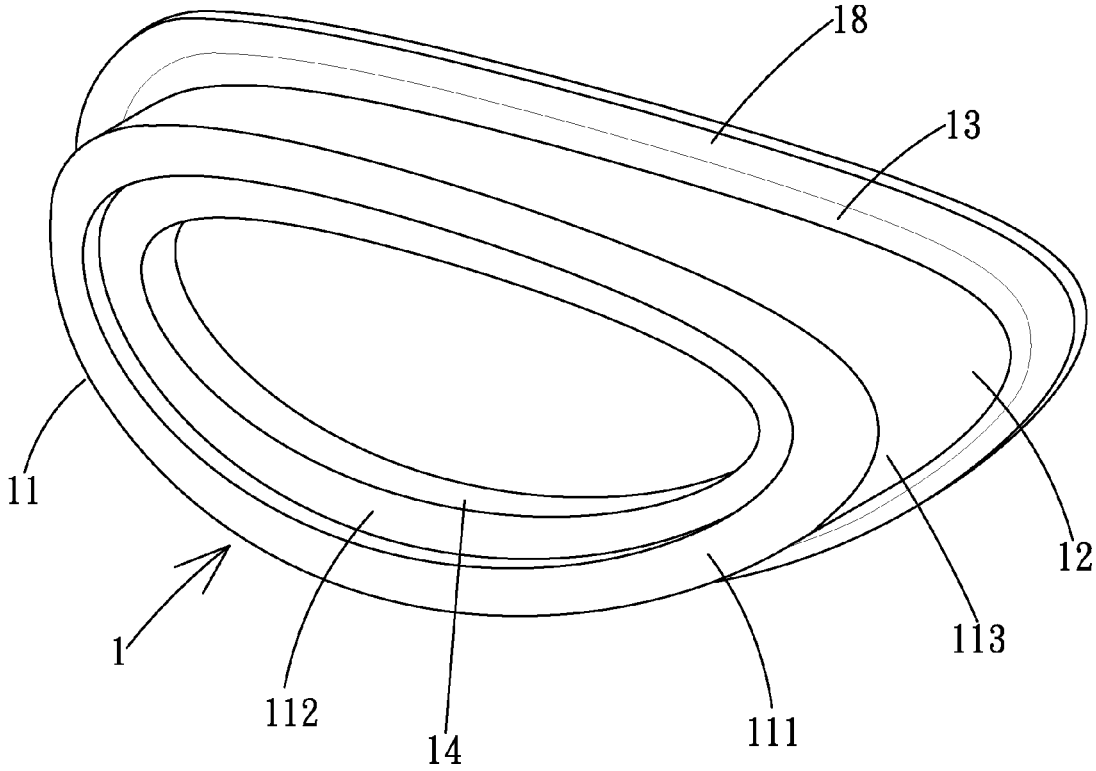
FIG. 6 shows a perspective view of the final product of the padding device of the first embodiment according to the present invention.

With reference to FIGS. 5, 5A, and 6, an annular engagement wall 18 is connected to the outer edges of the front and rear connecting walls 13 and 15 and extends perpendicularly to the annular, outer wall extension 12. The annular engagement wall 18 has an appropriate width for contact with a face of a wearer. The semi-processed product can be placed in a mold to form the annular engagement wall 18 that engages with the front and rear connecting walls 13 and 15, sealing the spacing portion 16 while covering the gap E between the front and rear connecting walls 13 and 15. A final product of the padding device with enhanced sealing effect in the spacing portion 16 is provided. However, the engagement wall 18 can be engaged with the front and rear connecting walls 13 and 15 by adhesive or other provisions.

With reference to FIG. 7, in use, the spacing portion 16 provides softness and wearing comfort. The engagement wall 18 is in intimate contact with the face of the wearer to enhance waterproof effect. Since the annular, inner wall extension 14 extends directly, perpendicularly, and rearward from the inner wall 112 of the connecting portion 11, the view of the wearer will not be adversely affected, providing enhanced view F for the wearer and increasing safety during swimming/diving.

Figures 8, 8A:
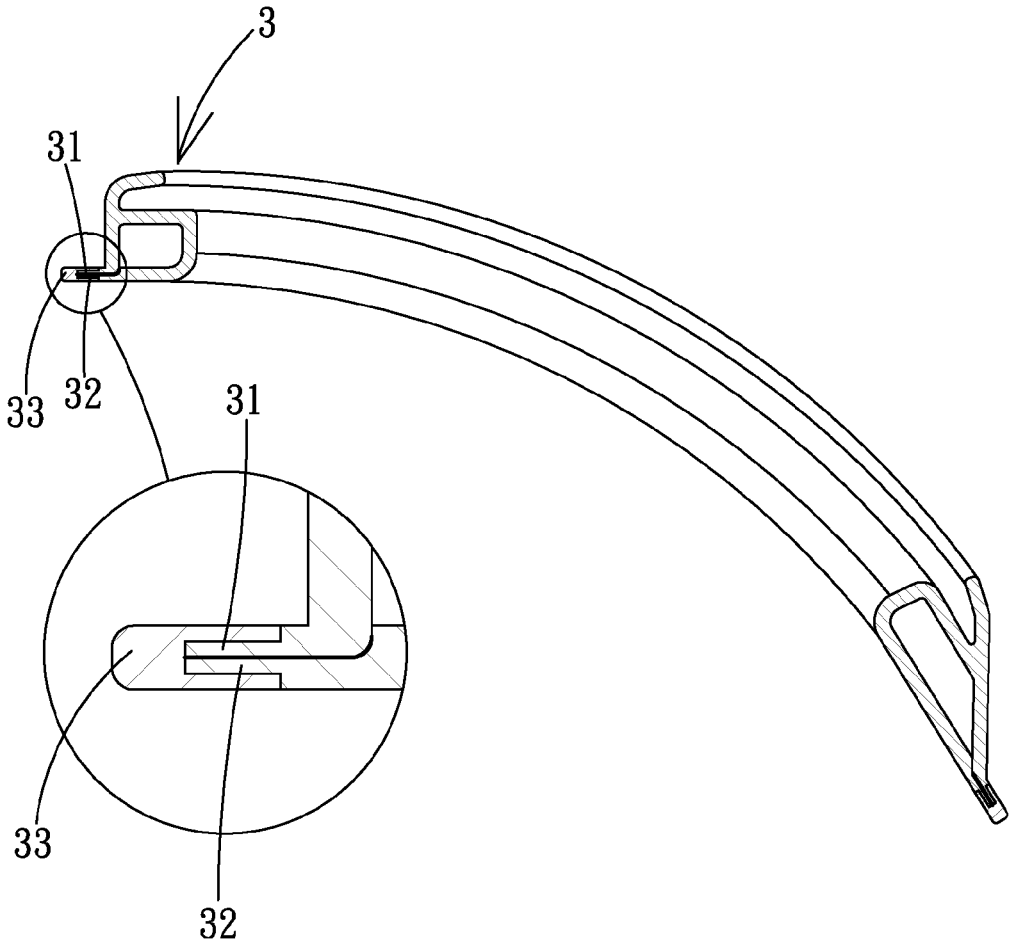
FIG. 8 shows a cross sectional view of a padding device of a second embodiment according to the present invention.
FIG. 8A shows an enlarged view of a circled portion of FIG. 8.

FIG. 8 shows a padding device 3 of a second embodiment according to the present invention similar to the first embodiment. The only difference between the first and second embodiments is that the engagement wall (now designated 33) envelopes the front and rear connecting walls (now designated 31 and 32). Furthermore, lateral faces of the front and rear connecting walls 31 and 32, a front face of the front connecting wall 31, and a rear face of the rear connecting wall 32 are engaged with the engagement wall 33. Thus, the resultant padding device 3 is more reliable and airtight.

Figures 9, 9A:
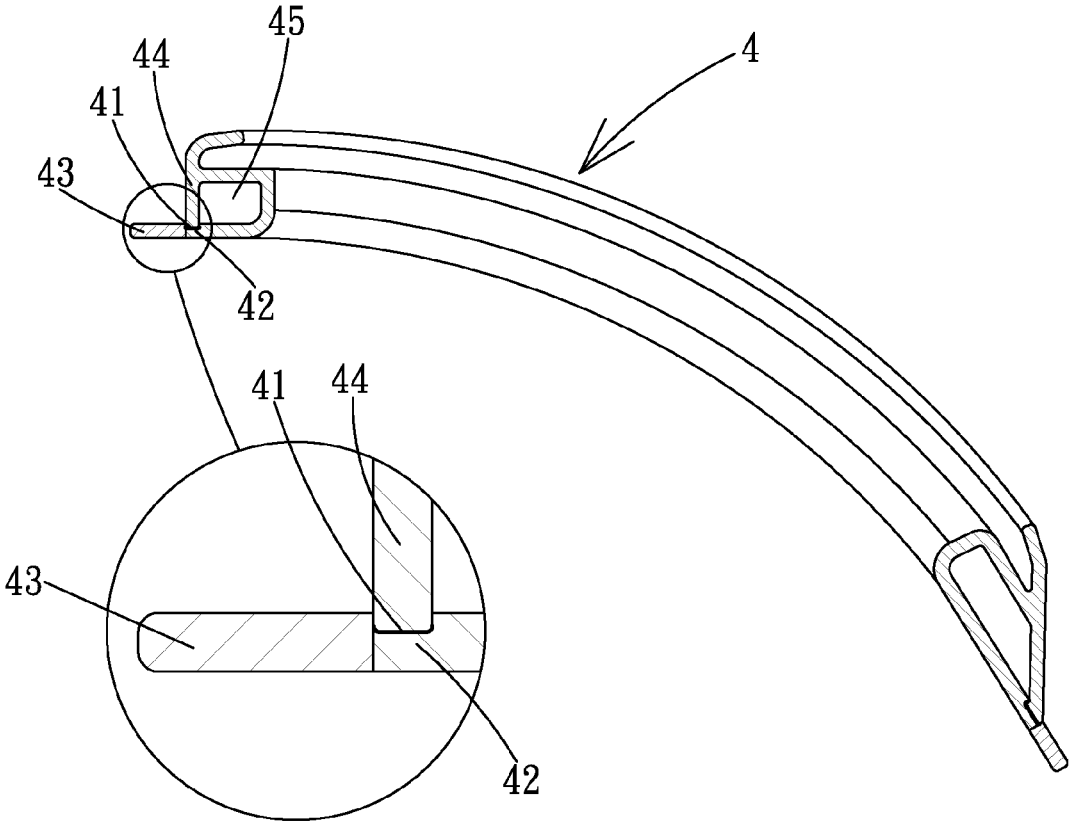
FIG. 9 shows a cross sectional view of a padding device of a third embodiment according to the present invention.
FIG. 9A shows an enlarged view of a circled portion of FIG. 9.

The front and rear connecting walls according to the present invention do not have to extend beyond the annular, outer wall extension. FIGS. 9 and 9A show a padding device 4 of a third embodiment according to the present invention similar to the first embodiment. The only difference between the first and third embodiments is that the front connecting wall (now designated 41) extends rearwards from the annular, outer wall extension (now designated 44). Furthermore, the rear connecting wall (now designated 42) is connected to the front connecting wall 41. Further, the engagement wall (now designated 43) extends outward from the annular, front and rear connecting walls 41 and 42 and extends perpendicularly to the annular, outer wall extension 44. The engagement wall 43 covers the gap between the front and rear connecting walls 41 and 42, enhancing the airtight effect at the spacing portion (now designated 45).

Figure 10:
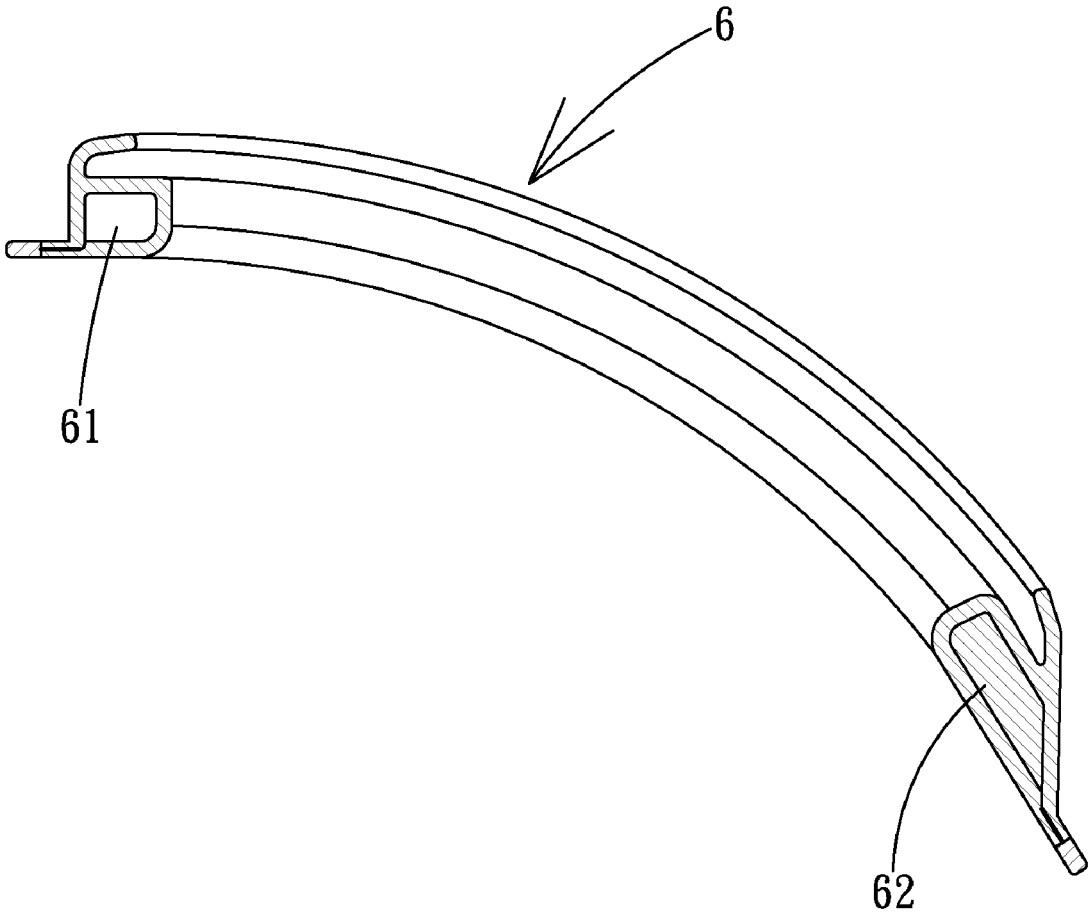
FIG. 10 shows a cross sectional view of a padding device of a fourth embodiment according to the present invention.

FIG. 10 shows a padding device 6 of a fourth embodiment according to the present invention similar to the first embodiment. The only difference between the first and fourth embodiment is that the padding device 6 includes a reinforcing plate 62 in the spacing portion (now designated 61). The reinforcing plate 62 reduces the deformation of the spacing portion 61 when the padding device 6 is in intimate contact with the face of the wearer.

Figure 11:
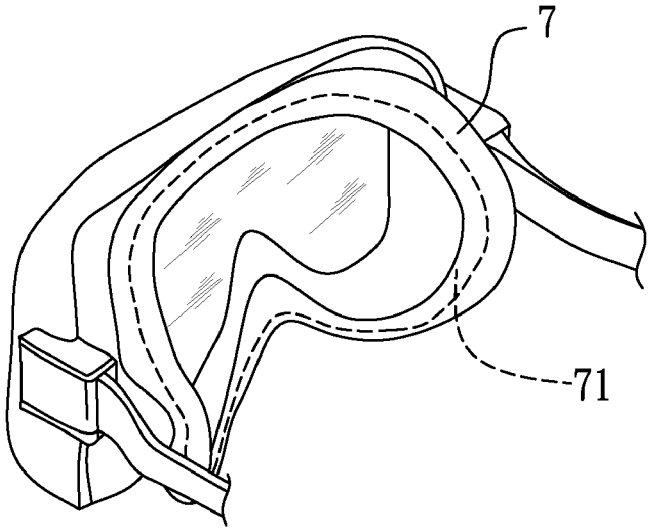
FIG. 11 shows a pair of swimming goggles using a padding device of a fourth embodiment according to the present invention.
Figure 12:
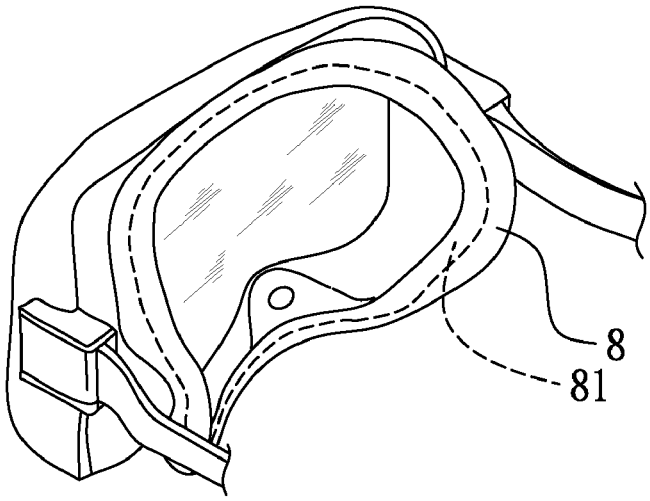
FIG. 12 shows a pair of diving goggles using a padding device of a sixth embodiment according to the present invention.
Figure 13:
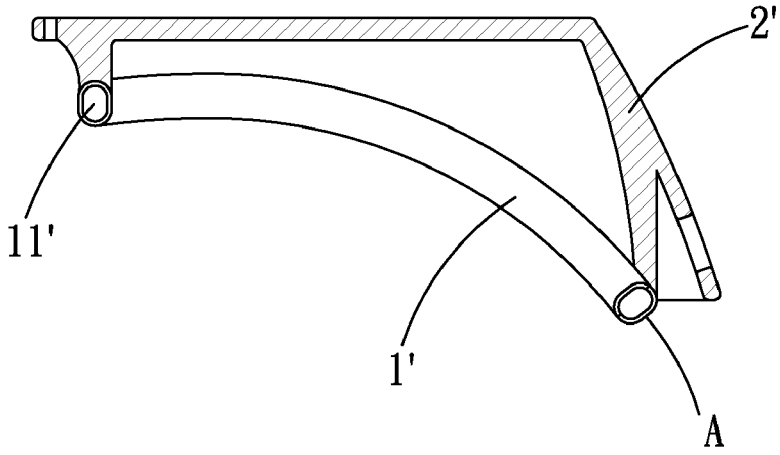
FIG. 13 (PRIOR ART)
FIG. 13 shows a partial, cross sectional view of a conventional padding device for swimming goggles.
Figure 14:
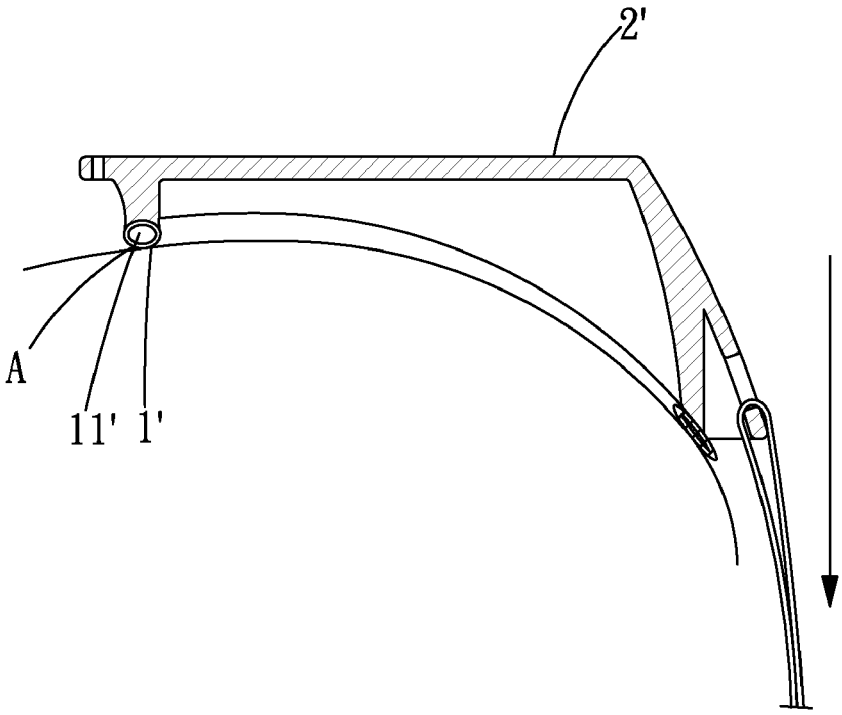
FIG. 14 (PRIOR ART)
FIG. 14 shows a partial, cross sectional view illustrating use of the conventional padding device of FIG. 13.
Figure 15:
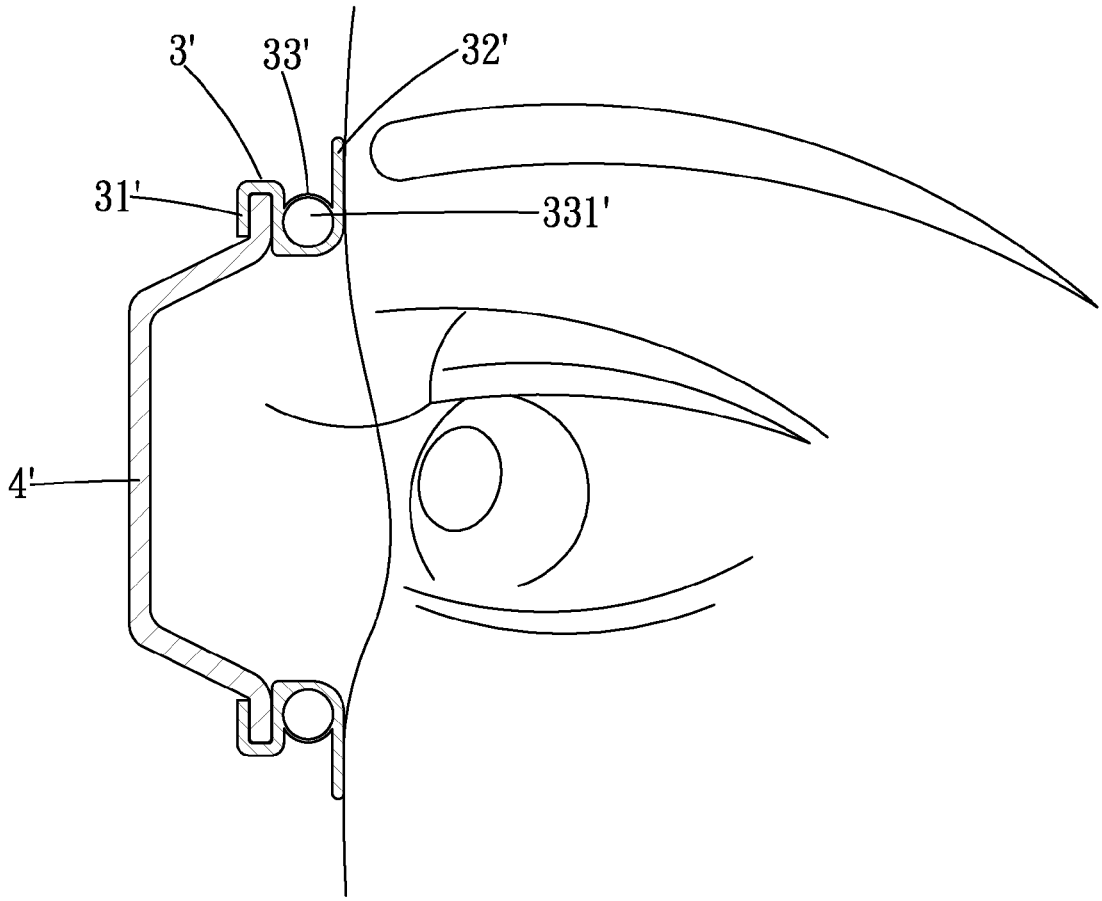
FIG. 15 (PRIOR ART)
FIG. 15 shows a cross sectional view of a pair of swimming goggles worn by a wearer, with the swimming goggles using another conventional padding device.
Figure 16:
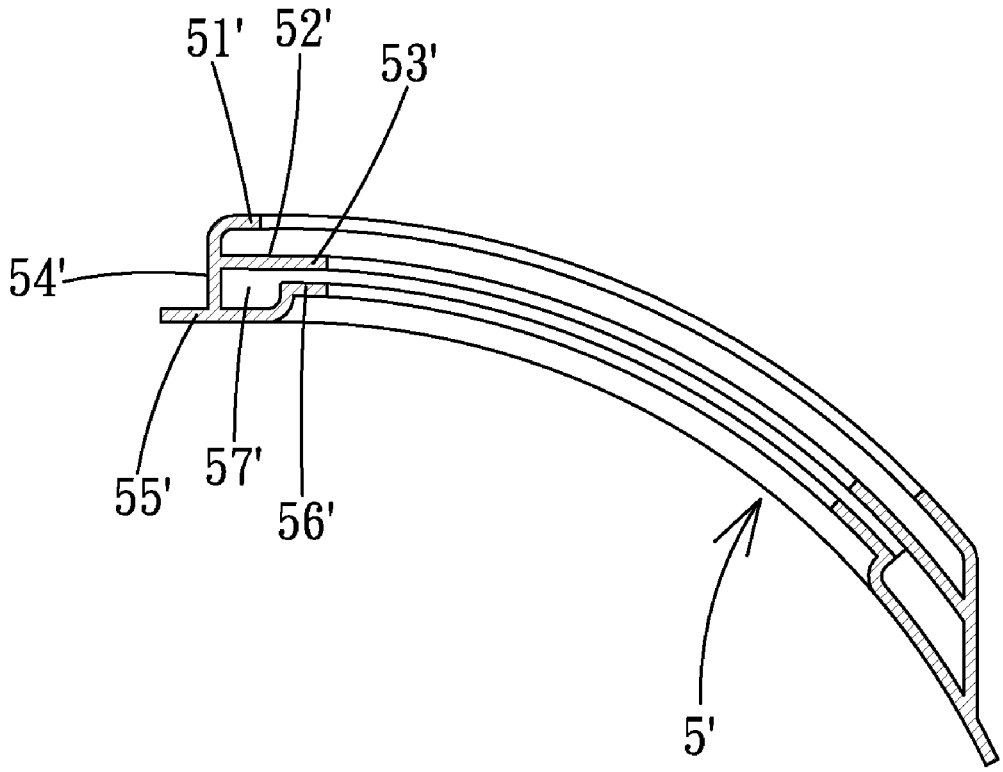
FIG. 16 (PRIOR ART)
FIG. 16 shows a partial, cross sectional view of a further conventional padding device.
Figure 17:
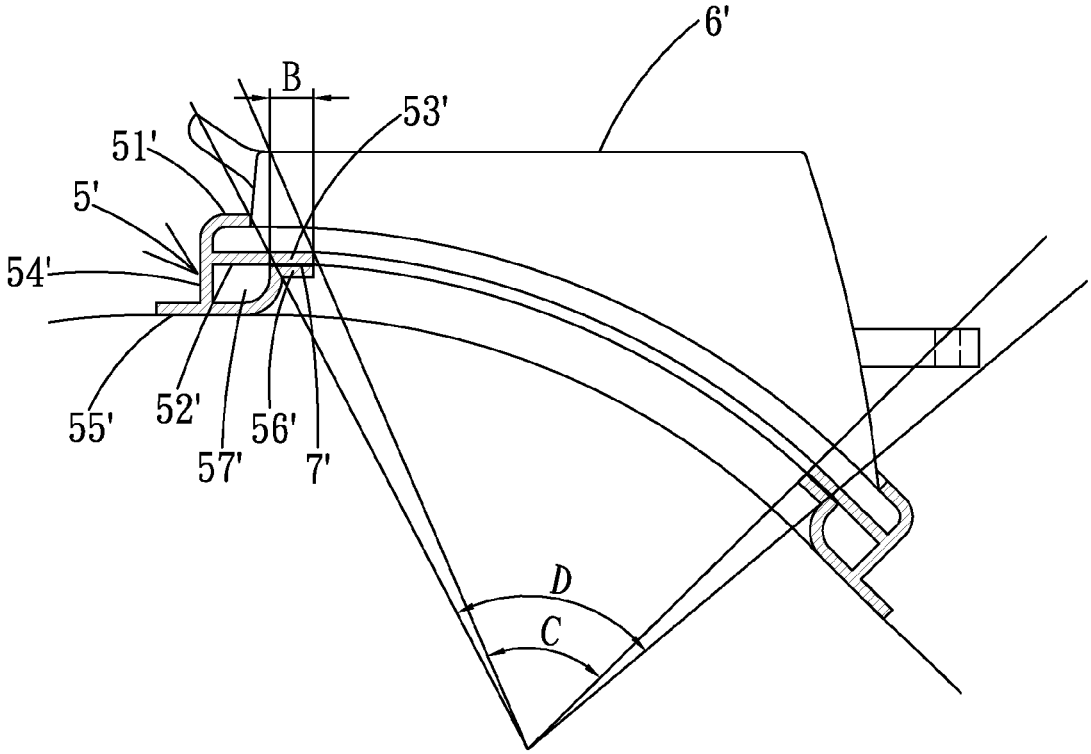
FIG. 17 (PRIOR ART)
FIG. 17 shows a cross sectional view of swimming goggles using the conventional padding device of FIG. 16.

A single padding device according to the present invention can be in intimate contact with two eye sockets of the wearer. FIG. 11 shows a padding device 7 of a fifth embodiment according to the present invention having structure similar to those shown. The padding device 7 is mounted to a pair of swimming goggle having a single lens. The padding device 7 surrounds the eye sockets of the wearer. The dotted lines 71 indicate the spacing portion of the padding device 7. FIG. 12 shows a padding device 8 of a sixth embodiment according to the present invention having structure similar to those shown. The padding device 8 is mounted on a pair of diving goggles and surrounds the eye sockets and the nose of the wearer. The dotted lines 81 indicate the spacing portion of the padding device 8.

Thus, the padding devices for swimming/diving goggles according to the present invention provide enhanced air-tight effect, wearing comfort, increased vision, and product consistency.

Although specific embodiments have been illustrated and described, numerous modifications and variations are still possible without departing from the essence of the invention. The scope of the invention is limited by the accompanying claims.

The invention claimed is:

1. A padding device for swimming/diving goggles comprising:

a connecting portion adapted to engage with a body of a pair of swimming/diving goggles, with the connecting portion including front and rear walls and a lateral wall extending between the front and rear walls;

an annular, outer wall extension extending rearward from the lateral wall of an engaging portion;

a front connecting wall extending from the annular, outer wall extension;

an annular, inner wall extension extending perpendicularly to and rearward from an inner edge of the rear wall of the engaging portion, with a bend extending outward from an inner end of the annular, inner wall extension and having a rear connecting wall located behind the front connecting wall, with a spacing portion defined between the annular, inner and outer wall extensions, with each of the front and rear connecting walls having an engagement face, with the engagement faces of the front and rear connecting walls engaged with each other and sealing the spacing portion to form a sealed cushion; and an annular engagement wall connected to outer edges of the front and rear connecting walls and extending perpendicularly to the annular, outer wall extension with each of the front and rear connecting walls extending outward and perpendicularly to and beyond the annular, outer wall extension, with each of the front and rear connecting walls having a lateral face, with the front connecting wall having a front face, with the rear connecting wall having a rear face, with the engagement wall engaged with the lateral faces of the front and rear connecting walls, the front face of the front connecting wall, and the rear face of the rear connecting wall.

* * * * *